US006215248B1

(12) United States Patent
Noll

(10) Patent No.: US 6,215,248 B1
(45) Date of Patent: Apr. 10, 2001

(54) GERMANIUM EMITTER ELECTRODES FOR GAS IONIZERS

(75) Inventor: Charles G. Noll, Sellersville, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 08/914,059

(22) Filed: Jul. 15, 1997

(51) Int. Cl.[7] ..... H01J 27/02

(52) U.S. Cl. ..... 313/633; 313/311; 313/310; 252/512; 361/222; 361/230; 250/324; 96/79

(58) Field of Search ..... 313/311, 310, 313/351, 336, 309, 633, 355; 252/512, 518; 428/641; 361/213, 220, 222, 230, 231; 250/324, 326; 96/79

(56) References Cited

U.S. PATENT DOCUMENTS 4,381,927 * 5/1983 Noll ..... 96/79
5,057,966 * 10/1991 Sakata et al. ..... 361/213
5,447,763 * 9/1995 Gehlke ..... 428/641

* cited by examiner

*Primary Examiner*—Sandra O'Shea
*Assistant Examiner*—Michael Day

(57) ABSTRACT

Germanium needles as emitter electrodes for use in low particle generating gas ionizers in general and static eliminators in particular. They oxidize with minimal incorporation of nitrogen, and the negative polarity emitters oxidize at a greater rate than the positive polarity emitters. Negative polarity silicon emitters generate several orders of magnitude greater particle emissions than either positive or negative germanium electrodes. The mean particle size is about 0.015 $\mu$m. No particles were shed from these needles. Lowest particle generation is achieved when germanium electrodes are purged with dry air.

17 Claims, 4 Drawing Sheets

GERMANIUM EMITTER ELECTRODES FOR GAS IONIZERS

TECHNICAL FIELD

Static elimination is an important activity in the production of advanced technologies such as ultra large scale integrated circuits, magnetorestrictive recording heads, and so on. The generation of particulate matter by corona in static eliminators, however, competes with the equally important need to establish environments that are free from particles and impurities. Since metallic impurities cause fatal damage to these advanced technologies, it is desirable to suppress those contaminants to the lowest possible level.

BACKGROUND ART

It is well known that when metallic ion emitters are subjected to corona discharges in room air, they show signs of deterioration within a few hours and the generation of fine particles. This is known for needle tips, copper, stainless steel, aluminum, and titanium emitters. Corrosion is found in areas under the discharge or subjected to the active gaseous species $NO_X$. $NO_3$ ions are found on all the above materials, whether the emitters had positive or negative polarity. Also, ozone-related corrosion is dependent on relative humidity and on the condensation nuclei density.

Silicon and silicon dioxide emitter electrodes experience significantly lower corrosion than metals in the presence of corona discharges. It is also known that by purging the emitter electrodes with dry air, $NH_4NO_3$ can be reduced as either an airborne contaminant or deposit on the emitters.

Surface reactions lead to the formation of compounds that change the mechanical structure of the emitters. At the same time, those reactions lead to the generation of particles from the electrodes or contribute to the formation of particles in the gas phase.

Silicon is known to undergo thermal oxidation, plasma oxidation, oxidation by ion bombardment and implantation, and similar forms of nitridation.

Prior art includes U.S. Pat. Nos. 5,447,763; 5,047,892; 5,057,966; 4,967,608; 3,789,278; 3,813,549; 4,110,614; 4,837,658; 5,539,205; 5,596,478; 5,116,583; and Japanese patent 7-70348. None of these, nor of many technical papers in the field teach or suggest the present invention.

DISCLOSURE OF THE INVENTION

BEST MODE FOR CARRYING OUT THE INVENTION

Germanium, unlike silicon, is not thermally oxidized at ambient pressure and is more difficult than silicon to oxidize by plasma processes. Nitridation is also more difficult in germanium. The increased difficulty for oxidation of Ge has been attributed to the greater standard reduced potential for Ge than for Si and, possibly, the different rates for migration of ions in the silicon and germanium oxide films.

Figure 1:
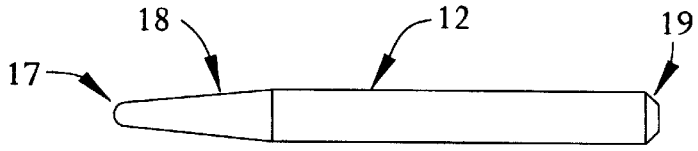
FIG. 1 is an side view of an emitter electrode showing some typical proportions and dimensions.

FIG. 1 is an side view of an emitter electrode 12 showing some typical proportions and dimensions. The electrode has a tip 18 ending with a spherical radius 17. The rear end has a chamfer 19. There is nothing limiting to this invention in the exact size, shape or proportions of the electrode. It is merely an example of a suitable electrode and illustrates the type used in the validating experiments.

In the experiments, silicon and germanium emitters were exposed to positive and negative polarity corona. The emitters were placed in a dry, simulated air environment for periods of up to 750 hr. Emitter samples were removed at nominal exposure times of 100, 250, 500, and 750 hours for visual (optical/SEM) examination, weighing, and x-ray photoemission spectroscopy (XPS) surface analyses.

The germanium emitters were made from >99.999% pure, n-type (antimony doped), polycrystalline germanium, they were unetched and have an electrical resistivity of 5–40 Ω-cm. An important characteristic of the present invention's germanium emitters in gas ionizers is that they be semiconducting so that they can support an electrical corona. More precisely, they must have an electrical resistivity between about 0.0–100 Ω-cm. This degree of resistivity can be met by doping with any known suitable conduction dopant, and is not limited to antimony. Furthermore, when the preferred antimony is used, it may be n-type or p-type. The silicon emitters were fabricated from >99.999% pure, p-type (boron doped), single crystal silicon; they were ground and bright etched and have an electrical resistivity of 40–100 Ω-cm. FIG. 1 shows an emitter with nominal proportions.

The emitter samples were chosen on the basis of their availability and with consideration of commercialized emitter materials used in the industry. More specifically, quartz coated tungsten has been found to produce no emitted particles larger than 0.03 μm. Silicon tipped silicon-carbide emitters are known, using a tip grown from a silicon melt. Reduced corrosion of the tips next to the metallic emitters was found. A 100-times reduction in particle generation compared to a thoriated tungsten base material has been claimed to be found in prior art in various emitter materials; pure zirconium titanium metals, silicon coatings formed by an electron beam physical deposition process, and homogeneous silicon materials. The purity (>99.99%) and homogeneity of the silicon was claimed a determining factor. Commercial application of a single-crystal silicon emitter is reported to generate 100-times fewer particles than thoriated tungsten points in the size range greater than 0.025 μm.

It is believed that the results of corona activity are relatively independent of surface orientation.

Figure 2B:
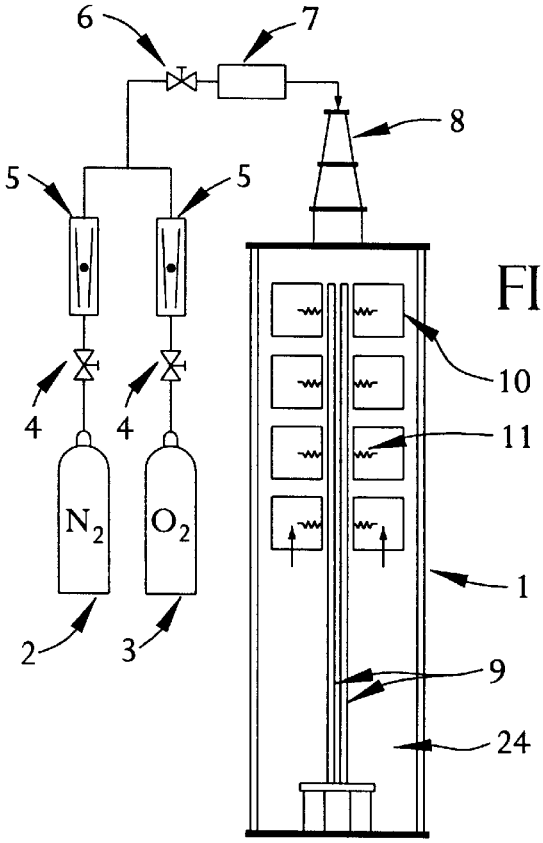
FIG. 2*b* is a side view of the test chamber shown in simplified and schematic form.
Figure 2A:
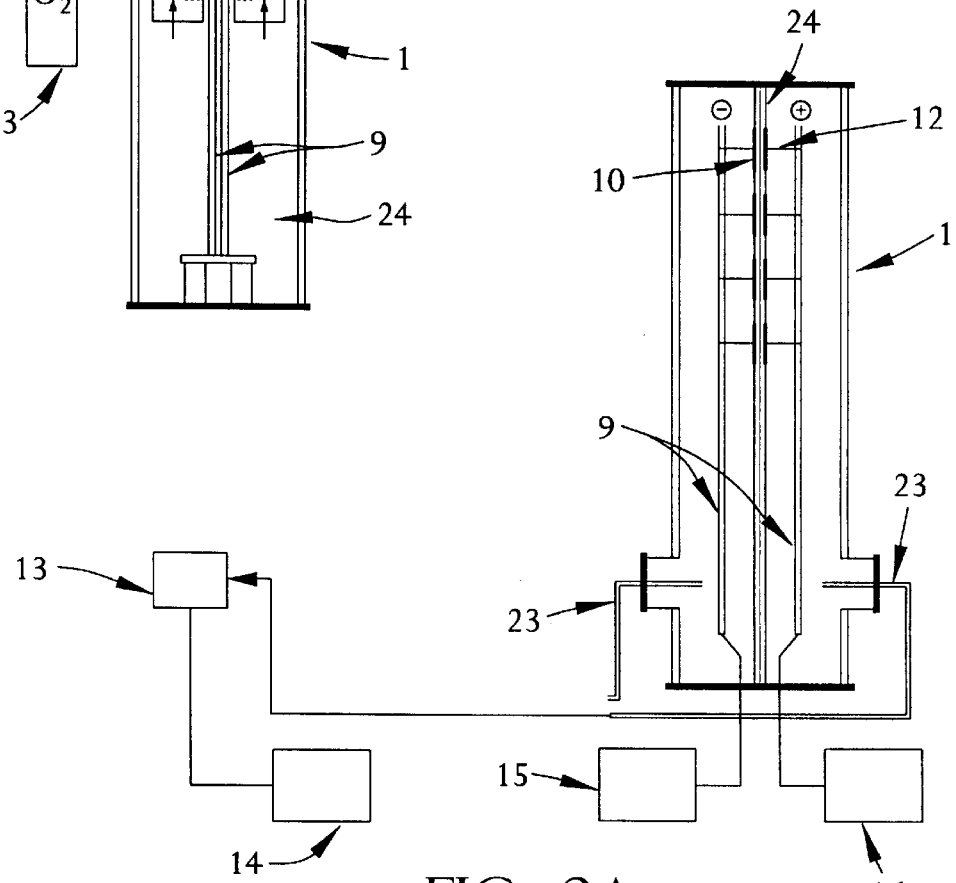
FIG. 2*a* is a front elevation of the test chamber shown in simplified and schematic form.

FIGS. 2*a* and 2*b* are schematic diagrams of the experimental test chamber setup. FIG. 2*a* is a front elevation of the test chamber shown in simplified and schematic form and FIG. 2*b* is a side view of the test chamber shown in simplified and schematic form.

The glass chamber 1 is a glass tube and is 0.96 m in height and has an inside diameter of 0.254 m. Oxygen is supplied from a tank 2 and nitrogen from a tank 3. The nitrogen and oxygen mixture is regulated by use of flow meters 5 and individual line valves 4. Flow rate of the mixed gasses is controlled by valve 6. A filter 7 is used to obtain a particulate and moisture free environment. The usual flow rates for oxygen and nitrogen gases during the experiments were 0.25 L/min and 1.0 L/min, respectively. The gases are dispersed into the test chamber 1 from the 76 mm diameter transition cone 8 and exhausted into openings located at the bottom of the chamber. Sampling is performed through two side ports 23.

A vertical glass plate 24 extending the full length and diameter of the chamber divides the chamber into two nearly independent parts. The plate was lightly sealed along its edges with Teflon gasket made of slit tubing. The presence of the cross contamination between the electrode sets led to significant and unexpected findings.

The test section consists of sixteen sets of electrode assemblies arranged in four columns of four independent emitter electrodes 12. Two columns, one with germanium emitters and one with silicon emitters, were positioned on each side of the glass plate divider. The emitters on one side of the plate were positive polarity, while those on the other side were negative polarity.

Each electrode assembly is comprised of one emitter and one 100 mm×100 mm copper plate 10. The copper plates are at ground. The distance between the emitter and ground electrode is set at about 16 mm. The voltage is applied to each emitter electrode through a 1 GΩ resistor 11 to help equalize the needle currents and to prevent any possibility of sparking during the tests.

High voltage of the appropriate polarity is applied to the emitters 12 on each side of the glass partition 24 by a steady O-25 kV dc power supply. The negative power supply 15 supplies the needles 12 on one side of the plate and postitive power supply 16 supplies the needles 12 on the other side of the plate. The current to each emitter was set about 4 $\mu$A, a current level which is typical of that encountered in ionizer products. The current is established by the electric field near the tips and set to the final value by adjustments to the electrode spacing. The current from each needle was monitored by the voltage drop across a 100 kΩ resistor.

The point-to-plane geometry sets the most severe, yet controlled, test for emitter electrodes. It also sets conditions for the electrostatic precipitation of some particulate matter generated by the emitters. Examination of deposits on the grounded counter electrode can yield information on elemental composition of particles generated by the corona. The ions reaching the counter electrode are thermalized at the fields and pressures used in the experiment, and their energy is about 0.026 eV. As a result there is no copper sputtered by ion bombardment. This does not preclude the chemical reactions which do happen at this electrode, as evidenced by the formation of circular patterns on the plates, but such reactions are not expected to release particles until relatively large deposits are made. This position was borne out in the findings of the experiments discussed below.

The aerosol concentrations and particle size distributions are measured using a condensation nucleus counter (CNC) and electrostatic classifier (EC), together indicated at 13 in FIG. 1. The CNC measures the total number concentration of particles with diameter greater than 0.01 $\mu$m; it samples at 300 $cm^3$/ min. The EC covers the size range from 0.011 to 05 $\mu$m. The EC delivers to the CNC a size-selected sample at a much lower concentration than the total particle concentration. The electrostatic classifier and CNC provide information on the submicron range of aerosol sizes; if larger particles had been detected by the classifier, a laser particle counter would have been used to extend the size measuring range. Other than during sizing with the classifier, the aerosol concentration was continuously monitored by the CNC and recorded by a computer 14. Samples were drawn from the positive negative sides alternately during the day, but towards the end of the exposure period, the negative side was monitored almost all the time.

To explain the test setup further. On one side of the glass plate, that is, in one isolated compartment, a set of germanium elctrodes and a set of silicon electrodes are provided. During any one test run, an ionizing voltage, say the negative voltage, is applied to either the germanium set or the silicon set. The other side of the plate also has a set of germanium elctrodes and a set of silicon electrodes and only either the germanium or the silicon set is provided with a positive voltage. A test run may involve, say, a positive germanium set on one side of the plate and a negative silicon set on the other side. By switching, there are four combinations available: silicon-silicon; germanium-germanium; positive Si-negative Ge; and negative Si-positive Ge.

Since the particle counter extracts its own sample at only 300 $cm^3$/min and reports the counts as concentration, the concentration in the chamber is the same as measured at the counter. The chamber flow rate is only used to infer the number of particles generated each second with the chamber from measurements of the concentration at the outlet. One criterion for selecting the chamber flow rate was to assure that the particle concentration at the outlet was within the range of measurement of the particle counter. A goal was to measure the relative particle generation rates for the various emitter samples, not concentrations in any cleanroom setting. It was also desired to gain information on the generated particles from deposits on the counter electrodes.

The principal work was performed in a dry, simulated air (80% nitrogen, 20% oxygen) atmosphere to avoid complications that might arise from airborne gaseous contaminants or the formation of hydrated species and ammonia that can be produced in corona. Tests were conducted in a Class 100 clean room with the emitters exposed to ambient moisture levels, typically 5000 ppm. The results from the latter tests are summarized.

The chamber nitrogen gas was obtained from a liquid nitrogen tank 3 and contains about 1 ppb $H_2O$. The level of moisture in the oxygen was higher, but the simulated air generally contained less than 50 ppm moisture. In the absence of corona, the background particle concentration was less than 0.01 $cm^{-3}$.

At the flow rates used in the tests, very little turbulence would be expected in the chamber. However, the corona needles were expected to induce motion in the gas, the "corona wind". In similar geometries, corona wind velocities of several meters per second have been observed. Corona wind mixing of the gas was therefore expected. When room air had been admitted to the chamber during change out periods, the concentration of particles was observed to decay exponentially with time, a characteristic of well-mixed chambers.

Although the corona current for each needle was initially adjusted to a nominal 4 $\mu$A (8 $\mu$A for the last 250 hours) and the positive and negative sets were occasionally reset to maintain that average current, some of the emitter currents changed over the course of the experiment. All the positive silicon needles remained within 5% of their starting values. Two of the positive germanium needles ran at about 5 $\mu$A each initially, but were close to 4 $\mu$A at 500 hours. Since the positive corona forms in the gas around the electrode it is not surprising that surface changes have little effect on the current.

The negative emitters showed greater changes, generally interpreted as decreases in current; since the average current was occasionally readjusted to the nominal value, some of the decreases were offset by increases on two needles. Even so, several silicon and germanium needle currents declined by 40 percent at the end of their exposures. The initial decay times for the currents appear to be on the order of 3 days for the silicon and 10 days for the germanium emitters.

On the face of it, the decline in currents can be interpreted as modification of the needle surface, because negative corona is mediated by photoionization and positive ion impact at the electrode surface. Some surface modifications improve the release of secondary electrons at the surface, while others may hinder their release. Both silicon and germanium needles showed some decreases.

Although particles were observed to be emitted in bursts when the power to the emitters was first turned on, the steady state emissions were much lower. In addition, by turning the power off to one side or the other, we determined that the positive emitters produced very low particle concentrations, less than 0.1 $cm^{-3}$. The negative emitters produced several hundred particles per cubic centimeter and roughly 1–2% were carried from the negative side to the positive side. The size distribution measurements were, therefore, attempted only on the particles generated by the negative emitters. By energizing only silicon or germanium emitters, independent determinations of the particle size were possible. However, the low concentrations made it necessary to average over long periods of time and limited the precision of the results. The particles emitted from both the silicon and germanium had mean diameters of about 0.015 $\mu$m, with a full size distribution width of about 0.01 $\mu$m, giving significant numbers of particles only between 0.01 and 0.02 $\mu$m. The counting statistics were inadequate to determine the size distribution more closely.

The negative corona was found to produce about 30 $cm^{-3}$ per needle initially (that is, 200 $cm^{-3}$ for 7 needles); by the end of the test period, the production rate was about 20 $cm^{-3}$ per needle. The positive polarity emitters produced about 0.03 $cm^{-3}$ per needle. In a comparison test, it was determined that the silicon needles produced 111 $cm^{-3}$ and the germanium needles produced 63 $cm^{-3}$ per needle, by separately energizing the negative silicon and germanium needles. Particles observed coming from the germanium emitters, however, are be silicon particles which had previously been deposited on these emitters through cross contamination from the negative silicon electrode. These two short term (about one hour) rates are both larger than the long term rate, 30 $cm^{-3}$ per needle. The reasons for this are not clear, but there are two possibilities.

First, the emitters and their counter electrodes act as small electrostatic precipitators that can charge and collect particles. Therefore, two sets of emitters are likely to collect more particles than one set. Second, the flow patterns in the chamber are expected to be different when one set is activated instead of two. The particle sample might be biased differently during the altered test conditions because of different flow patterns.

Under the assumption that the particles are well-mixed in the gas, a concentration of 30 $cm^{-3}$ per needle corresponds to a generation rate of 625 $s^{-1}$ per needle in the steady state. On the other hand, a particle burst when the negative power was applied could produce a concentration peak of $1.5\times10^5$ $cm^{-3}$; the concentration decayed so rapidly in this case that the well-mixed assumption is not valid. The burst might consist of very small particles, smaller than 0.01 $\mu$m, that coagulate rapidly to form more easily observed particles. Because the power-on bursts were first observed in the early stages of exposure, as well as near the end, the particles in the burst are probably not released from surfaces in the chamber.

The influence of corona on the germanium and silicon emitters was found to progress with time with large differences among the emitters. Table 1 summarizes the exposure and surface observations for the test series. XPS studies revealed minimal or no nitrates or incorporated nitrogen in the specimens at the sensitivity level of the equipment (1%). Samples were checked with up to 1200 s of 4 keV sputtering with argon ions.

TABLE 1

Needle Exposure Parameters and Observations

| Needle | Polarity | Exposure (hr) | Δ Weight ($\mu$g)[1] | Charge Xfer | $I_I/I_F$[2] | % Si | % O | % Ge |
|---|---|---|---|---|---|---|---|---|
| Si 11 | + | 100 | +2 | 60 | 1.13 | 23.40 | 35.47 | — |
| Ge 11 | + | 100 | +2 | 66 | 1.08 | 12.03 | 37.71 | 4.89 |
| Si 12 | + | 250 | +2 | 153 | 1.03 | | | |
| Ge 12 | + | 250 | +4 | 148 | 0.82 | | | |
| Si 13 | + | 500 | −2 | 313 | 1.02 | 22.64 | 56.30 | — |
| Ge 22 | + | 500 | +2 | 310 | 1.00 | 13.58 | 52.88 | 10.13 |
| Si 14 | + | 750 | 0 | 606 | 1.02 | | | |
| Ge 23 | + | 750 | +4 | 635 | 0.81 | | | |
| Si 15 | − | 100 | −4 | 61 | 0.73 | 26.20 | 51.16 | — |
| Ge 24 | − | 144 | +6 | 89 | 0.75 | — | 46.41 | 21.10 |
| Si 16 | − | 250 | +14 | 142 | 0.62 | | | |
| Ge 25 | − | 250 | 0 | 165 | 1.08 | | | |
| Si 17 | − | 500 | +33 | 252 | 0.65 | 23.94 | 68.02 | — |
| Ge 26 | − | 500 | +61 | 219 | 1.01 | — | 46.16 | 47.50 |
| Si 18 | − | 750 | +16 | 616 | 0.42 | | | |
| Ge 27 | − | 750 | +4 | 690 | 1.10 | | | |

[1]Weight resolution is ±2 micrograms.
[2]Ratio of initial to final needle currents.

Figure 3:
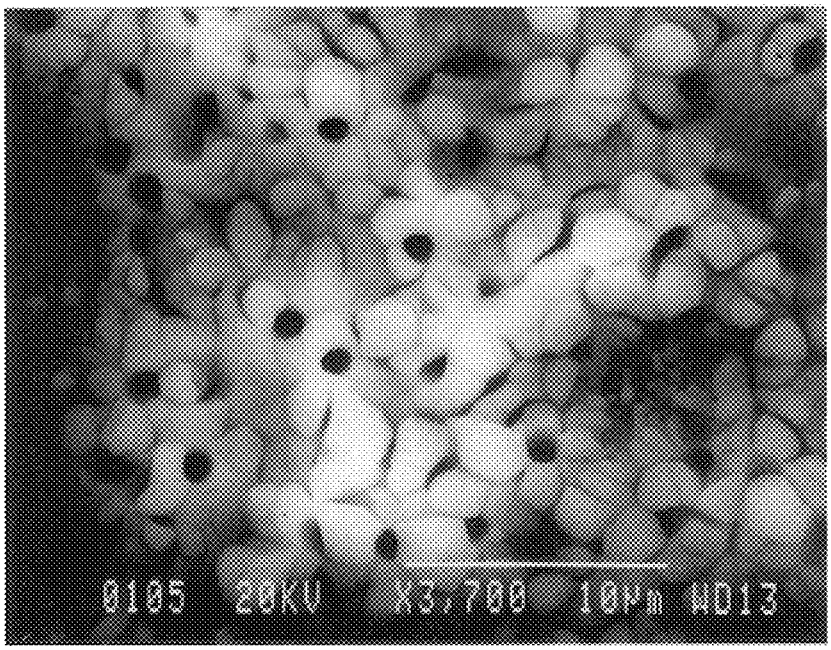
FIG. 3 is a scanning electron microscope photograph of the tip of a silicon electrode after test.

By light microscopy, the positive polarity silicon emitter did not appear to be influenced at all by corona through 500 hours. During the final 250 hours of testing, the current on the positive silicon emitter was increased from 4 to 8 $\mu$A and the tip developed a bluish tint to about 0.5 diameters from the tip; the bluish tint looked much like the bluing observed on heat treated steel. The tip (first ⅛ diameter) appears to be dulled and some fine particles are observed on the surface of the needle in the region with the bluish tint. There was no significant weight gain or loss during the tests with the positive silicon emitters. The changes in the positive polarity silicon needle are small compared to those for the other samples. A closer examination of the positive silicon emitters using scanning electron microscopy (SEM) revealed a patterned structure with fine holes or channels. An example of this structure is shown in FIG. 3, in which the dark irregularly shaped areas are the pores or holes. This same structure was observed in the positive silicon emitters at 750 hr, after operation of the needles at higher current. The tips of the silicon emitters progressively oxidized as seen by comparison of data in Table 1 for Si 11 and Si 13, and their resistivity increased as evidenced by the bright areas seen with electron illumination and charging during XPS analyses of the tips. Possibly, the pores are the result of discharges through the insulating layer.

The positive polarity germanium was observed to develop a brownish powdered tip during the first 100 hrs. of ionization. Behind the tip, the germanium cone developed a bluish tint, much like that seen on the positive silicon emitter at 750 hr. Both the brownish tip and bluish cone were in areas directly exposed to the corona and grew in size with the exposure time. Although some changes appear to occur at the germanium tips, there was no observed weight gain or loss on any of the emitters with positive polarity corona.

The SEM revealed an almost frothy appearance, with typical features on the order of 10 $\mu$m in size. At higher magnification the surface appears to be composed of particles or particle flakes which are bonded together. There are fractures and projections; one structure was observed to have grown about 30 microns from the surface.

XPS analyses of the surfaces of the Ge 11 and Ge 22 samples revealed the deposits to contain a large amount of silicon oxides, suggesting cross contamination between the emitters. This inference was borne out by the absence of silicon in subsequent observations using only germanium emitters in the test chamber.

It is, however, significant to point out that within the more random deposits on the positive polarity germanium emitters, there was a pore structure similar to that observed in the tips of the silicon samples shown above. Again, these are attributed to silicon oxide deposits. The surface layers were electrical insulators, before and after sputtering with 4 keV argon ions. The brownish appearance of the needle is believed to be the result of light scattered from the yellow germanium through the surface deposits.

The surfaces of the negative silicon and germanium emitters were both influenced by the corona. The surface finish of the negative polarity silicon electrodes had a uniform dull gray appearance where it was exposed to the corona. Under higher magnification, the tip seems coated with a layer of fine particles, approximately 1 $\mu$m in size that appear to be composed of agglomerates of finer particles. The texture was grainy, like fine sand. The transition from the dull to the shiny finish was abrupt and no discoloration of the cone was observed in the shiny region. Fine, fibrous particles were also observed on the surface of the emitter at 250 hr exposure, both in the dull gray and the shiny regions. Some of the fibers are straight, while others are irregular in shape or hooked. A crack was found in the surface of the needle after 750 hr of corona. Inspection of this crack revealed that the surface finish is about 1–2 particle layers thick: about 10–20 $\mu$m. There is no obvious erosion of the tip. If anything, the surface layer has thickened slightly by the formation or deposition of particles. The surface of the tip is bright under electron illumination, and again, this is the result of an electrically insulating surface film.

Figure 4:
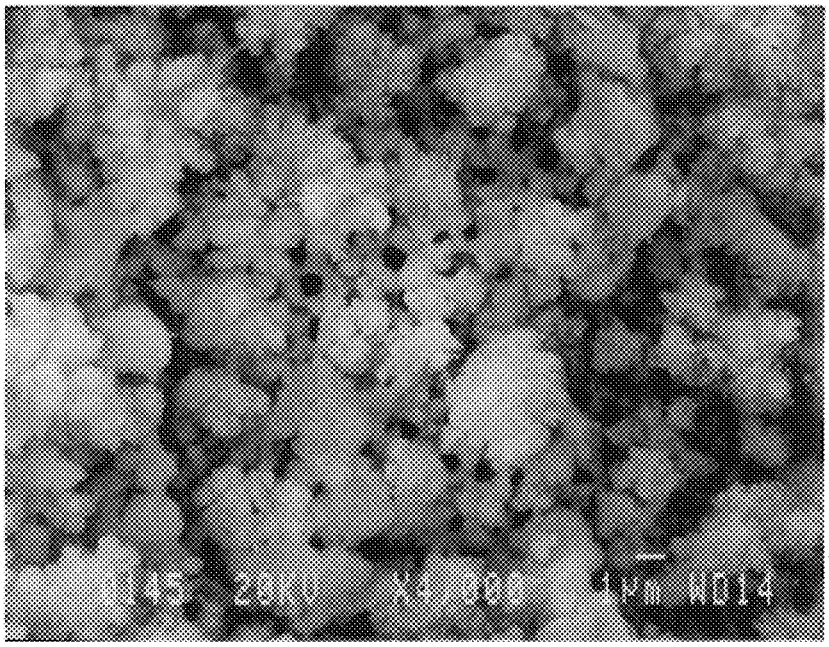
FIG. 4 is a is a scanning electron microscope photograph of the tip of a germanium electrode after test.

The germanium emitters gained a brownish deposit over about one tip diameter and had an irregular distinct boundary at 144 hr. Some lighter, tapered deposits were observed below the boundary where the shiny region extended into areas that had brownish deposits. After 250 hr exposure, the germanium tips had gained a region beyond the brownish deposit that had a bluish tint. SEM images revealed a coating of fine particle clusters. Typical cluster dimensions were on the order of 10 $\mu$m in size, and the fine particles were in the 1 $\mu$m size range and irregular in shape; these too are clusters of finer particles. There were occasional pores in the deposit similar to those observed on the silicon surface. FIG. 4 is a scanning electron microscope photograph of the tip of a germanium emmiter after test, and does not show the holes or pores on the silicon emmiter, as seen in FIG. 3.

Figure 5:
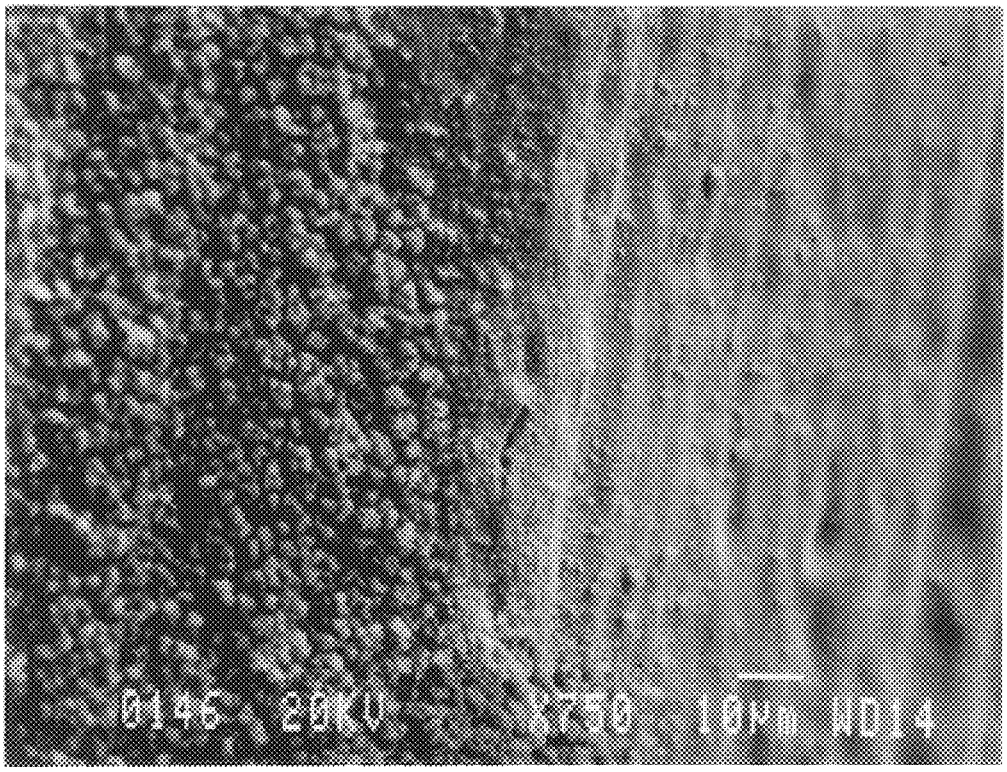
FIG. 5 is a scanning electron microscope photograph of the side of a germanium electrode after test, showing the transition between dull and shiny finish.
Figure 6A:
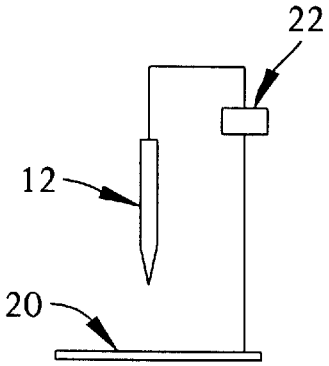
FIG. 6*a* is a schematic view of a point-to-plane corona producing device.
Figure 6B:
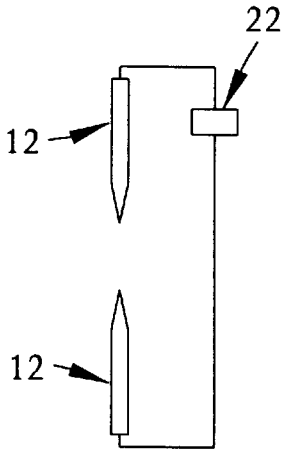
FIG. 6*b* is a schematic view of a point-to-point corona producing device.
Figure 6C:
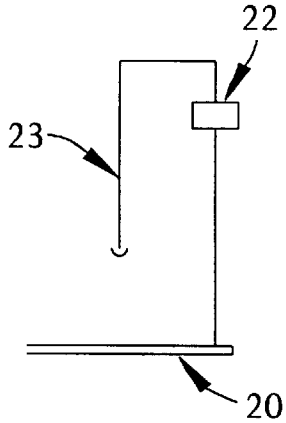
FIG. 6*c* is a schematic view of a wire-to-plane corona producing device.
Figure 6D:
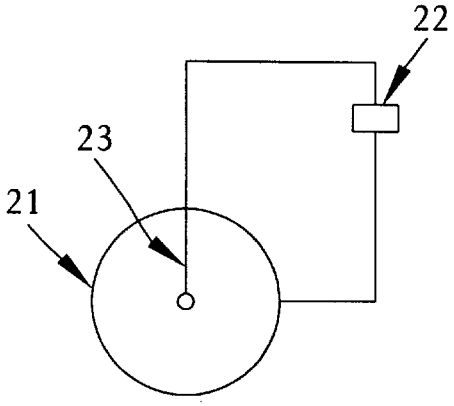
FIG. 6*d* is a schematic view of a wire to cylinder corona producing device.
Figure 6E:
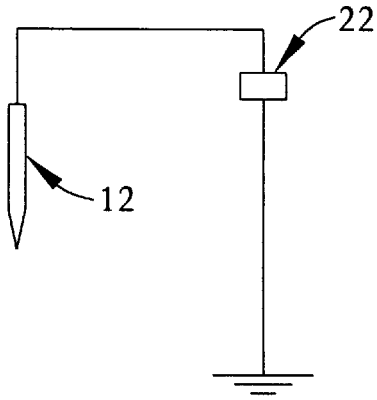
FIG. 6*e* is a schematic view of a point-to-room corona producing device.

FIG. 5 illustrates the transition between the shiny and reacted surface regions on the Ge 27 sample.

XPS analyses of the negative polarity germanium emitters did not indicate the presence of silicon in the surface of the needle tips. Also, germanium was not found on any of the silicon emitters or on the plate electrodes at ground potential.

There is less incorporation of oxygen in the positive polarity emitters, yet the abundance of oxygen increases with time for both positive and negative emitters. The spatial resolution of the XPS equipment (300 $\mu$m at one location and 800 $\mu$m at the other) prevented the stoichiometry from being measured on the positive polarity needles. The composition on the negative silicon needle appears to be near that for $SiO_2$.

There appear to be few or no particles generated by either the silicon or germanium positive emitters. Three observations support this: Direct measurement of particles with only the positive voltage applied yielded very low particle concentrations; Such particles as appear on the positive tips have come from the negative side, since there was a 1–2% carryover, by direct measurement and; The surface analyses from the positive emitters show a majority of silicon and oxygen on the germanium needles, with minimal germanium, whereas the negative germanium emitters show no evidence of silicon.

Within the scope of this investigation and consistent with the above observations,it was determined that all the particles are silicon-based. This is supported by the observation that the negative silicon emitters produced particles at twice the rate of the negative germanium emitters. It is conceivable that the germanium emitters were re-emitting silicon-based particles that had been attracted to the needles. The germanium oxidizes, at least on the negative emitters; but the oxide does not shed from the emitters.

The particles were not generated from the copper surfaces. Copper was not found separate from the grounded counter electrode surfaces—including analyses of the emitter surfaces and the needle cylinders, which are at high voltage and not producing corona. Germanium was also not found anywhere except on the germanium emitters.

Transmission electron microscopy (TEM) analyses of the counter electrodes also revealed no precipitated germanium; there were only silicon and silicon-copper composites on the counter electrodes. This was especially true under the germanium electrodes.

Follow-on tests were conducted with a single negative polarity germanium emitter in the experimental setup. These tests yielded a particle generation rate of 0.23 $cm^{-3}$, about two to three orders of magnitude below that for the negative silicon emitters.

Beyond this, there remains the challenge of interpreting the visible changes that occur on the needles. The deterioration of the emitters are unlikely to be due to heating. The temperature rise at the tips due to a 4 $\mu$A corona current is less than 3° C. However, the electron temperature in the plasma exceeds 10,000° C., so some thermal processes might be observed at the tips of the emitters. There is also the possibility of microspark discharges within the resistive deposits that coat the electrodes.

Neither the silicon nor germanium emitters of either polarity were found to generate significant numbers of particles larger than 0.02 $\mu$m in diameter. It was only in the size range from 0.01 to 0.02 $\mu$m and with negative polarity on the emitters that differences were observed in the materials. Previous studies with silicon reported only information for sizes greater than 0.025 $\mu$m. Particle generation at any size is a material transfer and potentially a contaminating process. In the present case, the particles are negatively charged and were shown to precipitate onto surfaces.

A significant characteristic and advantage of the present invention over prior art is the significant reduction of particles in the size range of about 0.01–0.02 microns produced by the negative emitter. The reduction of particle generation in this range is about 2–3 orders of magnitude less than such production from negative silicon emitters.

The make-up of ions from a typical ionizer is very complex and is far from understood. Many species are short lived , and these are often highly reactive. Most ionic species discussed in the literature are found in the interelectrode gap, after ion-molecule reactions have had time to develop. In the dry oxygen-nitrogen mixtures of the present experiments, the likely ionic species are $N_2^+$, $NO^+$, $N_2^+$, and $O_2^+$ for positive polarity corona and $NO_2^-$, $NO_3^-$, $O^-$, $O_2^-$, and $O_3^-$ for negative polarity corona. The $N_2^+$ ion is believed to rapidly convert to $NO^+$ and transfer charge to oxygen to form $O_2^+$. Free electrons drive the formation of radicals, such as the excited species $O^*$ and $O_2^*$ , and these lead to the formation of ozone. In positive corona, electrons are drawn to the positive electrode and less ozone is produced than in negative corona. However, the free electrons produced and the related free radicals are closer to a positive electrode's surface. The proximity of the positive corona reactions has been used to explain the greater corrosion that is typically observed at positive emitters over negative emitters in metals.

Although the above species are known to be present in the corona, the ion species that impact the needle tips are more likely to yield chemical activity at the emitters. Those species active at an electrode are expected to be the ones observed for the opposite polarity corona in the gaseous ion studies. There are oxygen, nitrogen, and $NO_X$ ion species bombarding the emitter surface.

The corrosive reactions on Si and Ge in the nitrogen-oxygen mixtures were observed to be significantly more destructive to the negative emitters than to the positive emitters. This result is in opposition to findings with metals. Work with nickel alloys has indicated that physical sputtering is not significant as a primary erosion mechanism in positive corona environments, where few negative ions can be accelerated over the short distance to the emitter. The role of ion bombardment in negative corona, and the enhanced corrosion of negative silicon and germanium emitters, points us towards considering ion bombardment and the possibility of physical sputtering in these materials.

The primary mechanism for electrode deterioration in silicon and germanium appears to be ion bombardment from the corona, with one difference from the metals. Unlike metals, where $N_3^-$ is found in the corrosion products, only oxides are observed on the silicon and germanium emitters. This result is consistent with the preference of silicon and germanium to oxidize before incorporation of nitrogen.

The very thick oxide layers, observed in the negative corona environment, may be due to several causes; Ions formed further from the emitter tip are accelerated to the surface and drive deeper oxide formation; The oxidation is enhanced by the strong applied field and current in the insulating surface layer and; The formation of very fine particles by oxygen/$NO_X$ reactions at the silicon tip to form SiO and its subsequent condensation and deposition.

The last of these mechanisms is most likely, since it would lead to the formation of 0.015 $\mu$m sized particles and can explain the formation of 10–20 $\mu$m thick deposits on the electrodes. Fine particles might also be formed by ion sputtering or electrical discharges through insulating deposits on the emitter tips. Mechanisms which result in deposit growth and flaking from the electrodes are expected to yield larger particles. Resistive oxide layers were observed to form on the emitters, and these crack or develop pores.

The lack of nitridation of both germanium and silicon suggests advantages for both of these materials for ionization in nitrogen environments.

Preliminary tests of germanium and silicon emitters were performed in a Class 100 clean room. A set of four electrodes, two at positive polarity and two at negative polarity, were run in a test air ionizer for a period of one month. The current on the needles was typically 2 $\mu$A each. At the end of the test, SEM images of the germanium and silicon emitters revealed deposits on both negative and positive emitters.

The air ionizer was the run in the Class 100 clean room to determine particle emissions using an airborne particle counter. Particle counts were accumulated over one minute intervals, and, unless an alarm threshold was exceeded, a record was printed on every tenth test. The smallest particle size measured was 0.3 $\mu$m, and the alarm level was set at a count rate of 300 for the one minute sample period. When the run began, the typical number of 0.3 $\mu$m particles was about 20 $min^{-1}$. This continued until the afternoon of the third day, when a large number of particles were emitted in bursts (300–650 $min^{-1}$) over an 8 hr period.

When the emitters are used in Class 100 cleanroom air, moisture hydrates many of the ion species, and reactions occur to form particulate matter. This material clings to the emitters and elevates particulate counts (and particle sizes) above those characteristic of emitter deterioration.

Germanium must be used with some consideration of its limitations. $GeO_2$ is the most likely oxide that is formed on the germanium emitter tip and it is known to be water soluble. The presence of water vapor in the Class 100 cleanroom air, however, did not seem to alter the surface reactions in ways that accelerate failure of the emitter materials. In fact, in the Class 100 clean room, the germanium emitters performed comparably to the silicon emitters, and possibly better. Germanium is also known to be more susceptible than silicon to etching in halogen plasmas. With and aside from these limitations, the benefits of advanced, nonmetallic emitters become best realized when ion generation is done in a dry, air-purged environment.

Germanium and silicon emitter electrodes oxidize by plasma and ion bombardment mechanisms. No nitridation of the materials was observed, in contrast to what might be expected from ion chemistry reported for semiconductor manufacturing processes and the nitrate formations found on metal emitters. The negative polarity silicon and germanium emitter electrodes oxidize at a greater rate than the positive polarity emitters, in contrast to findings with metallic emitters. The negative polarity silicon emitters generate several orders of magnitude greater particle emissions than the positive polarity emitters. Although the germanium emitters oxidize, no evidence was found to indicate particles are shed from this material over the month-long test. The form of corrosion on the negative emitters appears to be general oxidation, swelling, and flaking. For positive emitters, both silicon and germanium emitter tips develop pores or channels in the tips; some such pores can be seen in the structures on the negative tips as well. The germanium emitters appear to have a higher threshold ion energy than silicon that leads to electrode corrosion. This result is consistent with a general preference for oxidation of silicon over germanium. Best performance is achieved when the electrodes are purged with dry air.

In the experimental test setup, the needle and its resistor were arranged in-line. It was possible to make adjustments between the resistor and the needle so as to modify the voltage to the individual needle. In FIGS. 2*a* and 2*b*, the needles and each one's associated resistor are shown as if they are affixed to each other at right angles. Since this is a simplified and schematic drawing, more clarity in the presentation is made possible by the right angle arrangement, and the principle of operation is unchanged.

Prior art has suggested that single crystal silicon emitters are cleaner as to fine particulates than polycrystalline silicon emitters. The experiments in this present invention have found that polycrystalline germanium emitters are cleaner as to fine particulates than single crystal silicon emitters. Single crystal germanium is at least as good as or better than polycrystalline germanium in reducing fine particulates but is probably commercially unnecessary because of its increased cost. The prior art has suggested that silicon emitters must be solid or homogeneous, rather than being coated on a metallic substrate to avoid the problem of erosion of the coating and consequent exposure of the underlying metal which would produce more particles. Germanium emitters do not erode in this manner and therefore germanium coatings on the order of 10–20 microns or more without limitation on a metal substrate are acceptable.

I claim:

1. A corona-producing emitter electrode for ionizing gas, said electrode comprising pure germanium doped with a conductor so as to be a semi-conductor with a resistivity of between about 0.1 and 100 Ω-cm, whereby fine particle introduction from said emitter into said gas is reduced.

2. An emitter electrode as set forth in claim 1 wherein said emitter electrode is an antimony doped germanium.

3. An emitter electrode as set forth in claim 1 wherein said emitter electrode is >99.999% pure combined germanium and dopant.

4. An emitter electrode as set forth in claim 1 wherein said emitter electrode comprises polycrystalline germanium.

5. An emitter electrode as set forth in claim 1 wherein said emitter comprises monocrystalline germanium.

6. An emitter electrode as set forth in claim 1 wherein said emitter electrode is solid germanium.

7. A corona-producing emitter electrode for ionizing gas, comprising a coating of at least approximately 10–20 microns of germanium doped with a conductor so as to be a semi-conductor with a resistivity of between about 0.1 and 100 Ω-cm, on a substrate, whereby fine particle introduction from said emitter into said gas is reduced.

8. An emitter electrode as set forth in claim 7 wherein said emitter electrode is an antimony doped germanium.

9. An emitter electrode as set forth in claim 7 wherein said emitter electrode is >99.999% combined germanium and dopant pure.

10. An emitter electrode as set forth in claim 7 wherein said emitter electrode comprises polycrystalline germanium.

11. An emitter electrode as set forth in claim 7 wherein said emitter comprises monocrystalline germanium.

12. A corona-producing emitter electrode for ionizing gas, said electrode comprising pure germanium doped with a conductor so as to be a semi-conductor with a resistivity of between about 0.1 and 100 Ω-cm, producing reduced amounts of particles in the size range of about 0.01–0.02 microns.

13. An emitter electrode as set forth in claim 12 wherein said reduction takes place at the negative emitter.

14. An emitter electrode as set forth in claim 12 wherein said emitter electrode is an antimony doped germanium.

15. An emitter electrode as set forth in claim 12 wherein said emitter electrode is >99.999% combined germanium and dopant pure.

16. An emitter electrode as set forth in claim 12 wherein said emitter electrode comprises polycrystalline germanium.

17. An emitter electrode as set forth in claim 12 wherein said emitter comprises polycrystalline germanium.

* * * * *